US008622435B2

(12) United States Patent
Burchard et al.

(10) Patent No.: US 8,622,435 B2
(45) Date of Patent: Jan. 7, 2014

(54) SECURITY ELEMENT AND METHOD FOR PRODUCING THE SAME

(75) Inventors: Theodor Burchard, Gmund (DE); Winfried Hoffmuller, Bad Tolz (DE); Thorsten Pillo, Holzkirchen (DE); Manfred Heim, Munich (DE); Friedrich Kretschmar, Munich (DE); Jurgen Ruck, Schliersee (DE)

(73) Assignee: Giesecke & Devrient GmbH, Munich (DE)

( * ) Notice: Subject to any disclaimer, the term of this patent is extended or adjusted under 35 U.S.C. 154(b) by 289 days.

(21) Appl. No.: 11/573,506

(22) PCT Filed: Aug. 8, 2005

(86) PCT No.: PCT/EP2005/008568

§ 371 (c)(1), (2), (4) Date: Feb. 9, 2007

(87) PCT Pub. No.: WO2006/018172

PCT Pub. Date: Feb. 23, 2006

(65) Prior Publication Data

US 2008/0054621 A1 Mar. 6, 2008

(30) Foreign Application Priority Data

Aug. 12, 2004 (DE) ..... 10 2004 039 355

(51) Int. Cl.
*B42D 15/00* (2006.01)
*B42D 15/10* (2006.01)

(52) U.S. Cl.
USPC ..... 283/90; 283/72; 283/85; 283/87; 283/91

(58) Field of Classification Search
USPC ..... 283/72, 85, 87, 90–91, 94; 349/179, 349/168
See application file for complete search history.

(56) References Cited

U.S. PATENT DOCUMENTS

| | | | | |
|---|---|---|---|---|
| 5,284,364 | A * | 2/1994 | Jain | 283/87 |
| 5,678,863 | A | 10/1997 | Knight et al. | |
| 6,570,648 | B1 | 5/2003 | Muller-Rees et al. | |
| 6,582,781 | B1 | 6/2003 | Schuhmacher et al. | |

(Continued)

FOREIGN PATENT DOCUMENTS

| | | |
|---|---|---|
| DE | 04041025 | 6/1992 |
| DE | 19907697 | 8/2000 |

(Continued)

OTHER PUBLICATIONS

International Search Report, International Application No. PCT/EP2005/008568, 3 pages, Dec. 13, 2005.

(Continued)

*Primary Examiner* — Kyle Grabowski
(74) *Attorney, Agent, or Firm* — Lathrop & Gage LLP

(57) ABSTRACT

The present invention relates to a security element (30) for securing valuable articles, having a first layer (13), composed of cholesteric liquid crystal material, that is present at least in some areas, a second layer (14), composed of liquid crystal material, that is present at least in some areas, and a further layer (22), having a machine-readable feature, that is present at least in some areas and that is covered at least in some areas by the first and second layer composed of liquid crystal material.

37 Claims, 12 Drawing Sheets

(56) References Cited

U.S. PATENT DOCUMENTS

Figure 1:
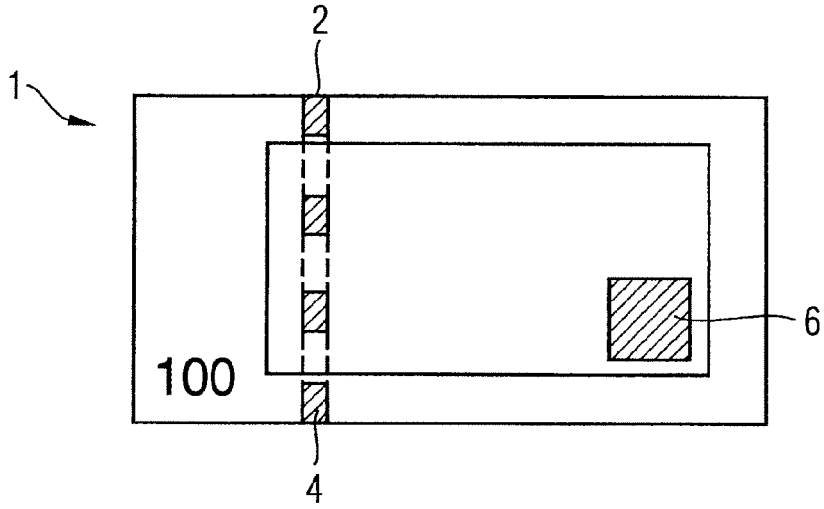

| | | | | |
|---|---|---|---|---|
| 6,667,797 | B2 * | 12/2003 | Wang et al. | 283/90 |
| 6,917,473 | B2 * | 7/2005 | Umemoto et al. | 359/599 |
| 6,955,839 | B2 * | 10/2005 | Gocho et al. | 428/1.2 |
| 7,040,663 | B1 * | 5/2006 | Plaschka et al. | 283/90 |
| 7,054,043 | B2 | 5/2006 | Mengel et al. | |
| 7,201,821 | B2 * | 4/2007 | Hoshino et al. | 283/90 |
| 7,401,817 | B2 | 7/2008 | Muller-Rees et al. | |
| 2002/0022093 | A1 | 2/2002 | Kuntz et al. | |
| 2003/0012935 | A1 | 1/2003 | Kuntz et al. | |
| 2003/0035191 | A1 * | 2/2003 | Moia | 283/90 |
| 2003/0179363 | A1 | 9/2003 | Wang et al. | |
| 2006/0097514 | A1 * | 5/2006 | Nishimura et al. | 283/90 |
| 2007/0165182 | A1 | 7/2007 | Hoffmuller et al. | |
| 2007/0211238 | A1 | 9/2007 | Hoffmuller et al. | |
| 2007/0216518 | A1 * | 9/2007 | Hoffmuller | 340/5.85 |
| 2007/0229928 | A1 | 10/2007 | Hoffmuller et al. | |
| 2007/0241553 | A1 | 10/2007 | Heim | |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0054621 | A1 * | 3/2008 | Burchard et al. | 283/72 |
| 2008/0079257 | A1 | 4/2008 | Fessl | |
| 2008/0088859 | A1 | 4/2008 | Depta | |
| 2008/0160226 | A1 | 7/2008 | Kaule | |
| 2008/0163994 | A1 | 7/2008 | Hoppe | |
| 2008/0198468 | A1 | 8/2008 | Kaule | |
| 2008/0216976 | A1 | 9/2008 | Ruck | |
| 2008/0250954 | A1 | 10/2008 | Depta | |
| 2008/0258456 | A1 | 10/2008 | Rahm | |

FOREIGN PATENT DOCUMENTS

| | | | |
|---|---|---|---|
| DE | 10044465 | | 3/2002 |
| DE | 10243650 | | 4/2004 |
| EP | 0435029 | | 12/1990 |
| EP | 0435029 | | 7/1991 |
| EP | 0516790 | | 12/1992 |
| EP | 0407550 | | 10/1994 |
| EP | 1120737 | | 8/2001 |
| EP | 1156934 | | 7/2003 |
| EP | 1381022 | | 1/2004 |
| EP | 0911758 | | 11/2005 |
| EP | 1628147 | A1 | 2/2006 |
| GB | 2276883 | | 10/1994 |
| GB | 2282145 | | 3/1995 |
| JP | 2000255200 | A | 9/2000 |
| JP | 2003145912 | A | 5/2003 |
| WO | WO 98/25236 | | 6/1998 |
| WO | WO 98/52077 | | 11/1998 |
| WO | WO 00/50249 | | 8/2000 |
| WO | WO 01/55960 | | 8/2001 |
| WO | WO 02/061470 | | 8/2002 |
| WO | WO 03/006261 | | 1/2003 |
| WO | WO 03/061980 | | 7/2003 |
| WO | WO 2004/028824 | | 4/2004 |
| WO | WO 2005/101101 | | 10/2005 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006015733 | | 2/2006 |
| WO | WO 2006018171 | | 2/2006 |
| WO | WO 2006018172 | | 2/2006 |
| WO | WO 2006040069 | | 4/2006 |
| WO | WO 2006056342 | | 6/2006 |
| WO | WO 2006072380 | | 7/2006 |
| WO | WO 2006087138 | | 8/2006 |
| WO | WO 2006099971 | | 9/2006 |
| WO | WO 2006119896 | | 11/2006 |
| WO | WO 2006128607 | | 12/2006 |
| WO | WO 2007006445 | | 1/2007 |
| WO | WO 2007006455 | | 1/2007 |
| WO | WO 2007076952 | | 7/2007 |
| WO | WO 2007079851 | | 7/2007 |
| WO | WO 2007115648 | | 10/2007 |

OTHER PUBLICATIONS

International Preliminary Report on Patentability, International Application No. PCT/EP2005/008568, 7 pages, Feb. 20, 2007.
U.S. Appl. No. 11/568,538, filed Sep. 23, 2008, Depta.
U.S. Appl. No. 11/719,843, in pre-exam, Kaule.
U.S. Appl. No. 11/909,115, filed Sep. 19, 2007, Kretschmar.
U.S. Appl. No. 11/995,227, in pre-exam, Gruszczynski.
U.S. Appl. No. 12/097,834, filed Jun. 17, 2008, Kaule.
U.S. Appl. No. 12/294,222, in pre-exam, Hoffmuller.
International Search Report, International Application No. PCT/EP2005/004673, 4 pages, Aug. 4, 2005.
International Preliminary Report on Patentability, English Translation, International Application No. PCT/EP2006/001169, 5 pages.
International Search Report, International Application No. PCT/EP2005/004683, 6 pages, Dec. 6, 2005.
International Preliminary Report on Patentability, English Translation, International Application No. PCT/EP2005/004683, 14 pages.

* cited by examiner

SECURITY ELEMENT AND METHOD FOR PRODUCING THE SAME

CROSS-REFERENCE TO RELATED APPLICATIONS

This application is the U.S. National Stage of International Application No. PCT/EP2005/008568, filed Aug. 8, 2005, which claims the benefit of German Patent Application DE 10 2004 039 355.9, filed Aug. 12, 2004, both of which are hereby incorporated by reference to the extent not inconsistent with the disclosure herewith.

The present invention relates to a security element for protecting valuable articles. The present invention further relates to a method for manufacturing such a security element, as well as a valuable article that is equipped with such a security element.

For protection, valuable articles such as branded articles and value documents are often equipped with security elements that permit the authenticity of the valuable article to be verified, and that simultaneously serve as protection against unauthorized reproduction.

There is a permanent interest in protecting security papers against forgeries and unauthorized reproduction. Particularly in view of today's copying and printing techniques, it is becoming ever more difficult to find effective security features that, if not prevent unauthorized reproduction or forgery, then at least make it clearly recognizable.

In many cases, optically variable elements that, at different viewing angles, give the viewer a different image impression, for example a different color impression, are used as security elements. From publication EP 0 435 029 A2 is known such a security element having a plastic-like layer composed of a liquid crystal polymer, which layer displays a marked play of changing colors at room temperature. The optically variable effects of the liquid crystal polymers can be checked purely visually, for example by tilting the security element, and are thus easily observable, even for laypersons. The wavelength-selective reflectivity and the polarization effects of the material also facilitate a mechanical check of such security elements. However, optically relatively complex verification and detector arrangements are required for this.

It has long been known to provide security documents with security threads composed of plastic that exhibit a magnetic coating and thus serve as a machine-readable security feature. EP 0 407 550 A1 describes, for example, a security document having an embedded security thread that is provided with a binary code composed of magnetic material.

However, since such security elements offer no possibility for a quick visual verification as is needed in many situations in daily life, it was likewise suggested to combine machine-verifiable security features with visual features. A security document having such a security element is already known from EP 0 516 790 A1. The security thread described here consists of a transparent plastic substrate layer having a metallic coating in which gaps are provided in the form of characters or patterns, so-called inverse lettering. If the thread is present in the paper pulp, these gaps and the metallic surroundings are hardly visible when viewed in reflected light. However, when viewed in transmitted light, the transparent gaps stand out in strong contrast from their opaque surroundings and are thus easily perceptible. At the same time, the security element exhibits a magnetic coating that is provided, for example, below the metal layer in the border areas of the thread and symmetrically to the gaps along the direction in which the element runs in the document.

Based on that, the object of the present invention is to specify a security element of the kind cited above that offers increased counterfeit protection and simultaneously avoids the disadvantages of the background art.

This object is solved by the security element having the features of the main claim. A method for its manufacture and a valuable article having such a security element are specified in the coordinated claims. Developments of the present invention are the subject of the dependent claims.

According to the present invention, the security element exhibits, at least in some areas, a first layer composed of cholesteric liquid crystal material and, at least in some areas, a second layer composed of liquid crystal material. Moreover, the security element includes a further layer that is present at least in some areas, having a machine-readable feature that is covered at least in some areas by the first and second layer composed of liquid crystal material.

In addition to novel, visually verifiable effects that exploit the properties of the combined liquid crystal layers, this security element has the advantage of machine verifiability. Here, compared with the individual security features, increased counterfeit protection is ensured through the particular reciprocal mapping on the security element.

In a preferred embodiment, the security element exhibits an opaque layer that is provided at least in some areas. In it, first gaps that are perceptible in transmission can be provided in the form of patterns and/or characters as a first piece of information. In the context of the present description, the term "opaque" means non-sheer in the sense of a certain light resistance such that, for example, (transparent) gaps that are present in the opaque layer stand out in contrast in transmitted light, but also the effects of the liquid crystal layers disposed on such a layer are easily perceptible.

To further increase the perceptibility of the below-described color and polarization effects of the layers composed of liquid crystal material, the opaque layer can further be present as a dark, preferably black layer. For this, it can, for example, be formed from black printing ink or a black-colored lacquer.

Advantageously, the opaque layer itself can further be magnetically and/or electrically conductive and/or luminescent and in this way provide the further layer having the machine-readable feature. Alternatively, the opaque layer can also be present as a separate layer.

In a preferred embodiment, a second piece of information can be provided in the form of second gaps in the opaque layer that differ in size from the first gaps. The gaps can constitute, for example together with the first and/or second layer composed of liquid crystal material, an additional piece of information, especially in the form of a new geometric shape.

In an advantageous variant of the present invention, the circular polarization direction of the light that the second layer composed of liquid crystal material reflects, itself or in coaction with the first layer composed of liquid crystal material, is opposite to the circular polarization direction of the light reflected by the first layer. In this way, it is possible to encode in one or more of the liquid crystal layers pieces of information that can be read out only when circular or linear polarizers are used. If the second layer is also formed from cholesteric liquid crystal material, then in addition, it is also possible to increase the intensity of the total light reflected by using the two opposite circular polarization directions.

According to a preferred embodiment, the second layer composed of liquid crystal material forms a phase-shifting layer. Preferably, the second layer for light from the wavelength range reflected by the first layer substantially forms a $\lambda/2$ layer. Here, the second layer is preferably formed from nematic liquid crystal material that facilitates the manufacture of optically active layers due to the optical anisotropy of the aligned rod-shaped liquid crystals.

To weaken the effect of the λ/2 layer in some regions and/or to produce new effects, the λ/2 layer can also be formed from multiple sub-layers that are stacked and, in some areas, twisted toward one another in the layer plane. Here, the sub-layers are particularly advantageously formed by two λ/4 layers. Through different twisting of the two λ/4 sub-layers in some areas, their influence on circularly polarized light can be systematically used to produce, for example, encoded half-tone images.

According to a further preferred variant of the present invention, the wavelength range in which the second layer selectively reflects light differs from the wavelength range in which the first layer selectively reflects light. Here, the second layer is expediently formed from cholesteric liquid crystal material. For example, it can be provided that, in one viewing direction, at least one layer of the first and second layer reflects only light from the non-visible part of the spectrum. As explained in detail below, additive color mixing of the reflection spectra of the two layers composed of cholesteric liquid crystal material permits the production of broader and unusual color-shift effects. Here, the light from the non-visible part of the spectrum can be, for example, infrared radiation or ultraviolet radiation.

Furthermore, in other embodiments, at least one further layer composed of cholesteric liquid crystal material can be provided. Preferably, at least one of the layers composed of liquid crystal material is present in the form of pigments that are embedded in a binder matrix. Such pigments are easier to print than liquid crystals from solution and do not place such high demands on the smoothness of the background. Moreover, the pigment-based printing inks need no alignment-promoting measures. Furthermore, at least one of the layers composed of liquid crystal material can advantageously be present in the form of characters and/or patterns.

Further, in all described embodiments, a separate first magnetic layer can be provided at least in some areas. Here, this layer is preferably covered by the opaque layer. For example, the first magnetic layer can be present in the form of spaced apart magnetic areas that form a code. Here, the first and/or second gaps in the opaque layer are expediently disposed in the magnetic-layer-free in-between areas. Furthermore, the code can extend only across a sub-area of the security element. However, the first magnetic layer can also be present in the form of longitudinal strips that run parallel to the thread direction.

According to a further preferred variant of the present invention, a second magnetic layer is provided. It can likewise be disposed such that the gaps that are perceptible in transmission remain uncovered. The second magnetic layer can, for example, join the magnetic areas of the code with each other.

In all described embodiments, a separate electrically conductive layer can also be provided at least in some areas. Preferably, it is present in the form of a layer that is formed from electrically conductive strips that run parallel to the thread direction, or that is substantially transparent.

According to a preferred variant of the present invention, additionally or alternatively, a separate metallic layer can be provided at least in some areas. It can likewise exhibit gaps. However, the separate metallic layer can also be present contiguously, especially as a screened metal layer or as a thin, contiguous semitransparent metal layer. Here, in the context of the present description, the term "semitransparent" or "translucent" means sheer in the sense of a certain transmittance, but unlike with transparent materials, objects located behind translucent materials are perceptible only diffusely or not at all. The semitransparent metal layer preferably exhibits an opacity of 40% to 90%. The screened metal layer can be present as a negative screen, especially in the form of transparent, i.e. demetallized dots, as a positive screen, especially in the form of metallic dots, or as a line grating, especially in the form of diagonal metallic strips.

In all embodiments, the separate metallic layer can be covered at least in some areas by the opaque layer, especially by the black-colored lacquer. Here, in addition to the black-colored lacquer, areas of a layer composed of a transparent lacquer can also be applied on the separate metallic layer. Moreover, the separate metallic layer can additionally exhibit magnetic properties.

Furthermore, in the described embodiments, at least one of the layers of the security element can include at least one additional authenticating feature, for example in the form of luminescent substances, color pigments and effect pigments that are introduced into the appropriate layer. Alternatively or additionally, separate layers having a luminescent substance can also be provided.

In all described embodiments, it can be provided that the layers of the security element are disposed on an at least translucent plastic layer.

In an advantageous embodiment, the security element takes on the form of a thread or strip that is at least partially embedded in a document material, such as banknote paper, or that can also be disposed on the surface. In a further advantageous embodiment, the security element forms a label or a transfer element.

The present invention also comprises a method for manufacturing a security element of the kind described, in which a first layer composed of cholesteric liquid crystal material and a second layer composed of liquid crystal material are applied to a substrate foil such that they are stacked in an overlap area. Here, the two liquid crystal layers can each be applied on a separate substrate foil, especially imprinted, and then laminated one on top of another. This allows, right after application to the substrate foil, the liquid crystal layers to be checked for suitability for further processing and, if applicable, eliminated. Alternatively, the two liquid crystal layers can also be applied successively on the same substrate foil.

After the application of the first and second layer composed of liquid crystal material, these layers are applied in such a way to a further layer that is present at least in some areas and has a machine-readable feature that the further layer is covered at least in some areas by the first and second layer composed of liquid crystal material. The further layer having the machine-readable feature can be printed on with an opaque layer, for example before application of the first and second layer composed of liquid crystal material.

The present invention further comprises a valuable article, such as a branded article, a value document or the like, having a security element of the kind described. The valuable article can especially be a security paper, a value document or a product packaging.

Valuable articles within the meaning of the present invention include especially banknotes, stocks, identity cards, credit cards, bonds, certificates, vouchers, checks, valuable admission tickets and other papers that are at risk of counterfeiting, such as passports and other identification documents, as well as product protection elements, such as labels, seals, packaging and the like. In the following, the term "valuable article" encompasses all such articles, documents and product protection means. "Security paper", on the other hand, is understood to be the not yet circulatable precursor to a value document. Security paper is customarily present in quasi-endless form and is further processed at a later time.

Further exemplary embodiments and advantages of the present invention are explained below by reference to the drawings, in which a depiction to scale and proportion was omitted in order to improve their clarity.

Figure 2:
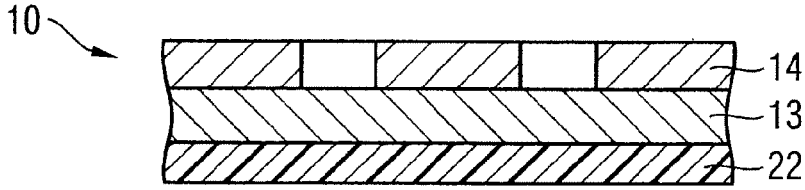
Figure 3:
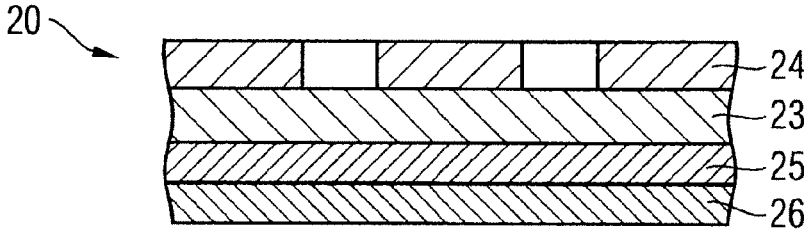
Figure 4A:
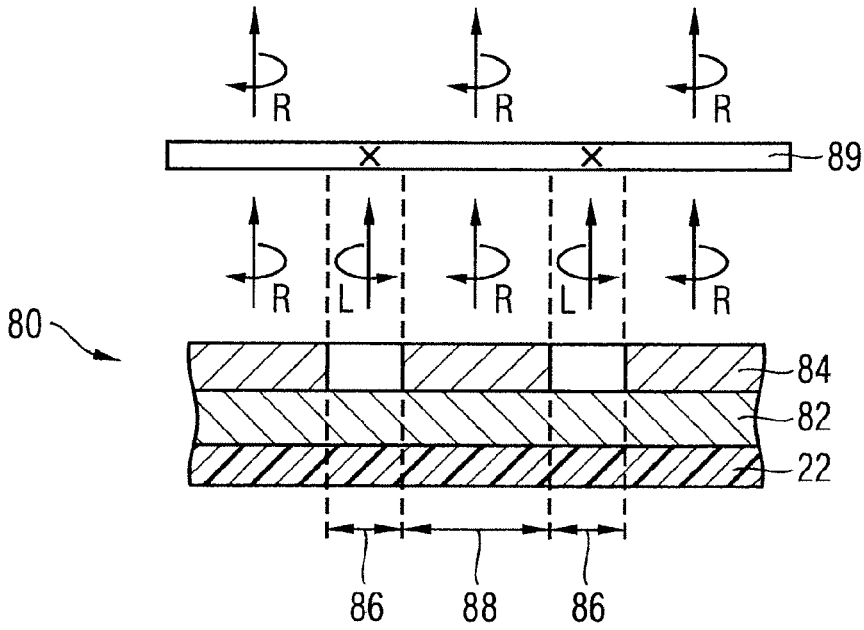
Figure 4B:
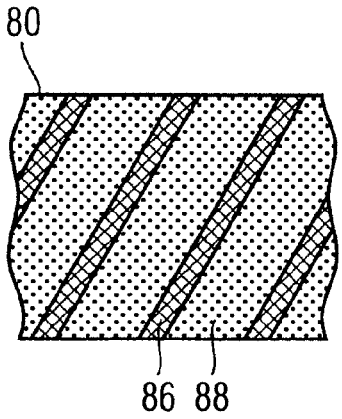
Figure 4C:
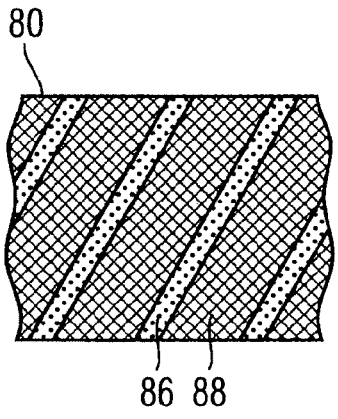
Figure 5A:
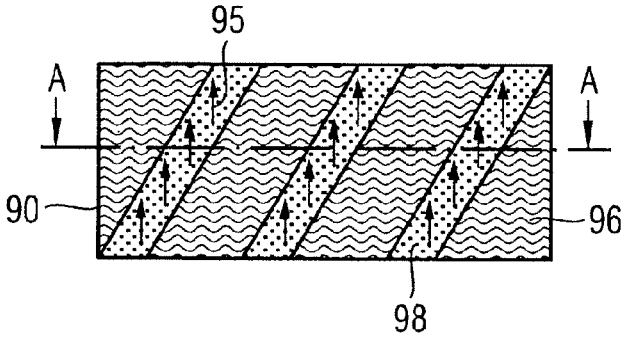
Figure 5B:
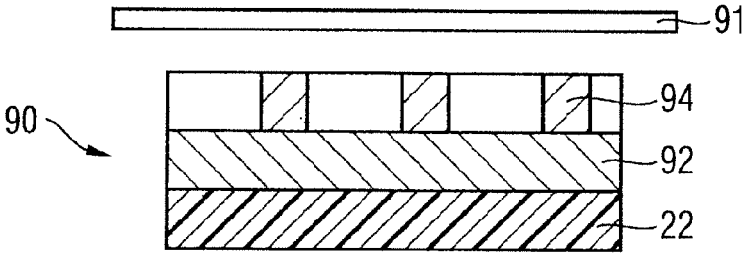
Figures 5C, 5D, 5E, 5F:
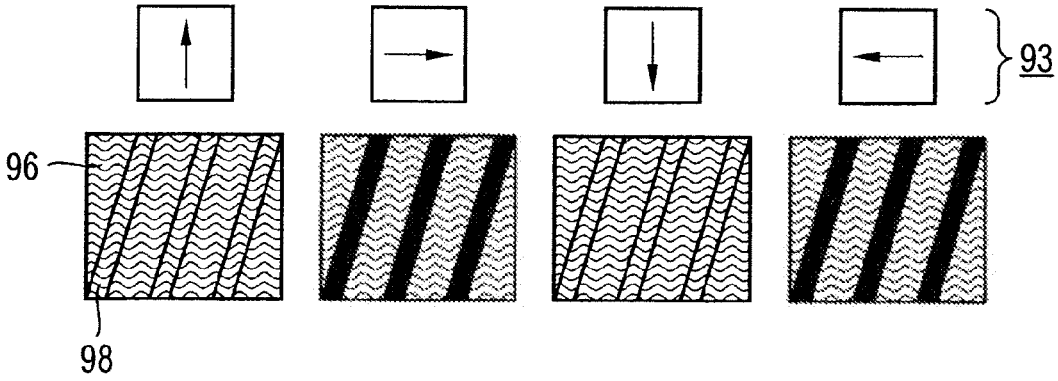
Figure 6A:
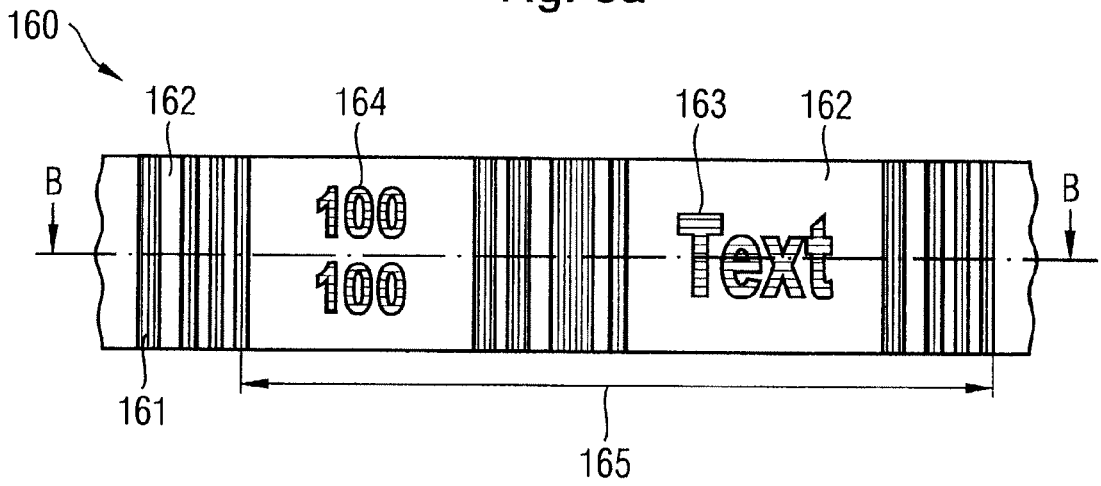
Figure 6C:
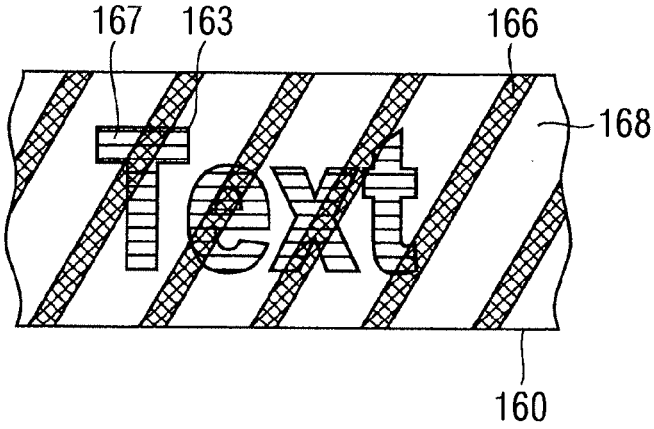
Figure 6D:
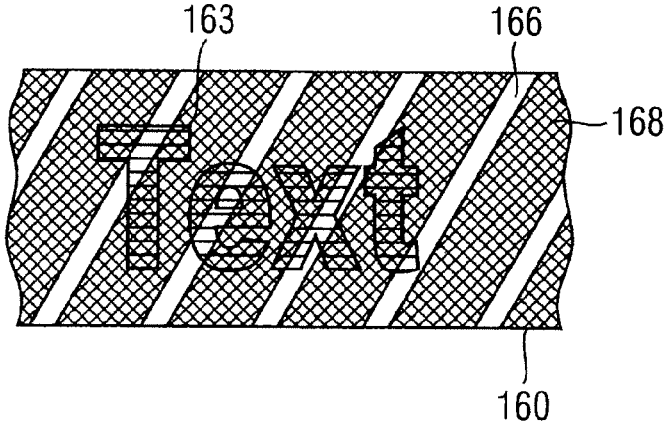
Figure 6B:
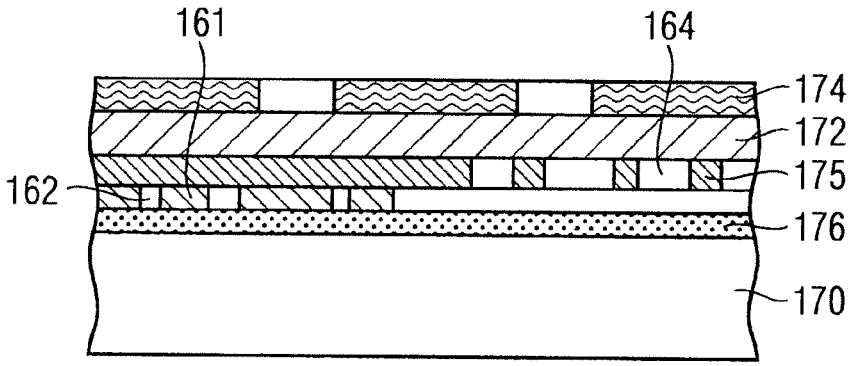
Figure 7:
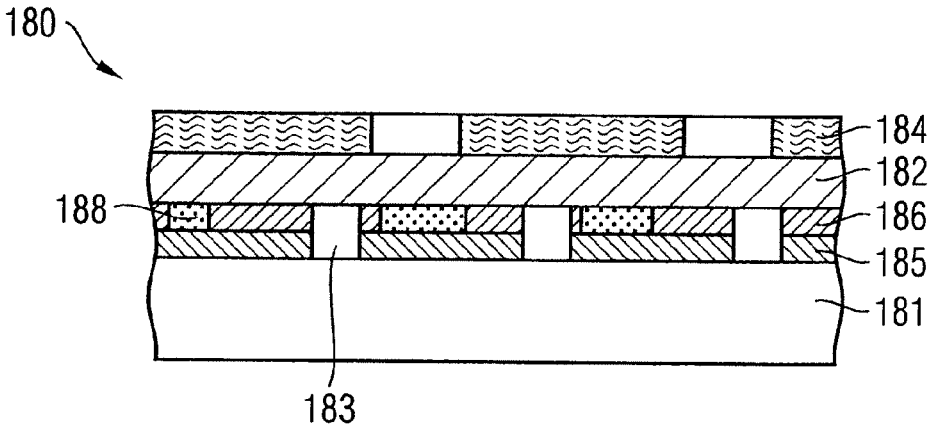
Figure 8A:
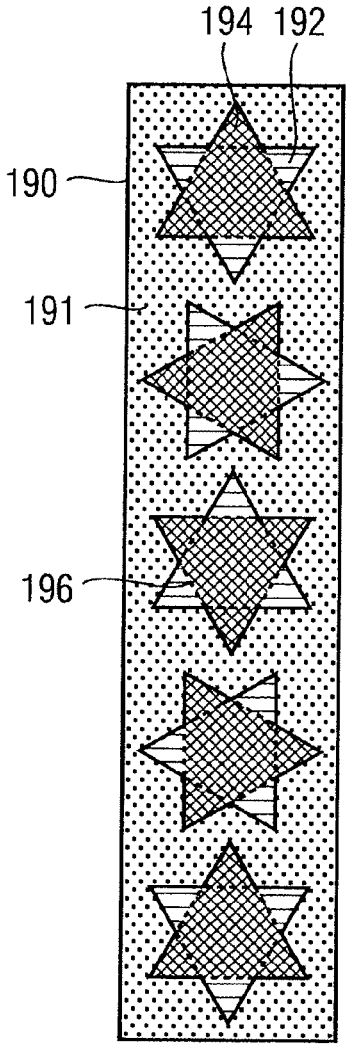
Figure 8B:
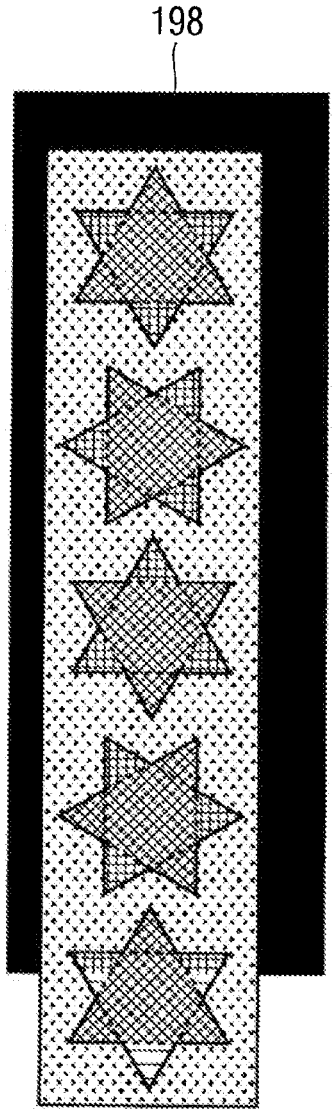
Figure 8C:
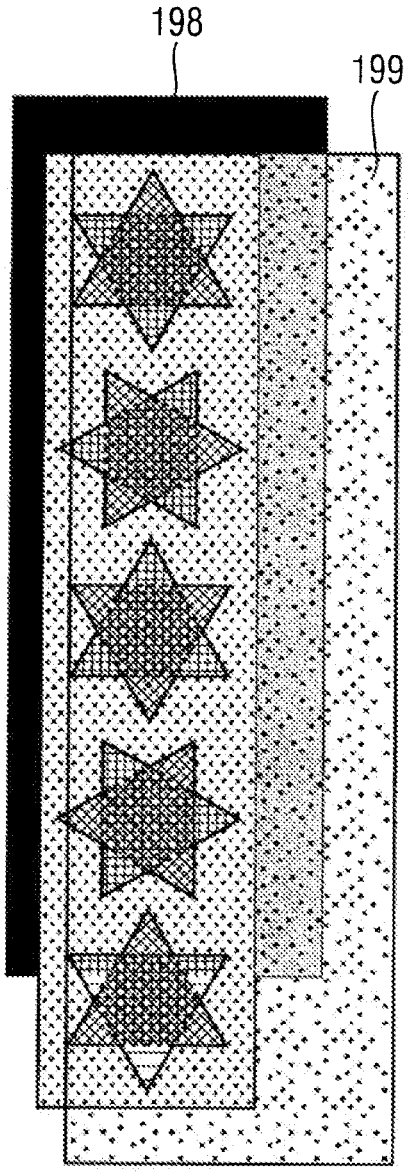
Figure 8D:
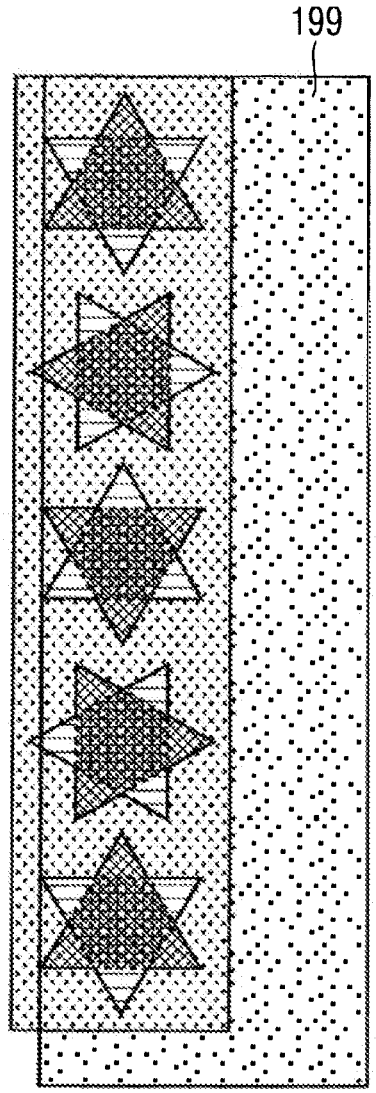
Figure 9:
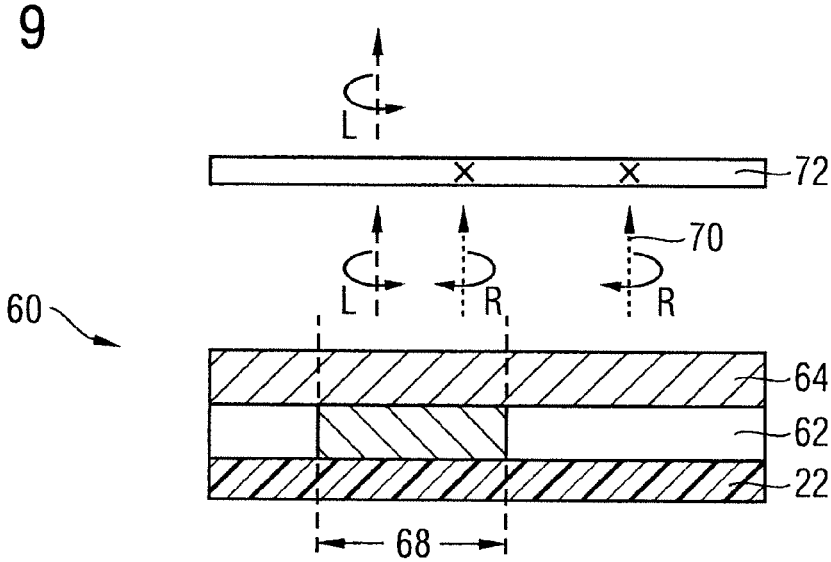
Figure 10:
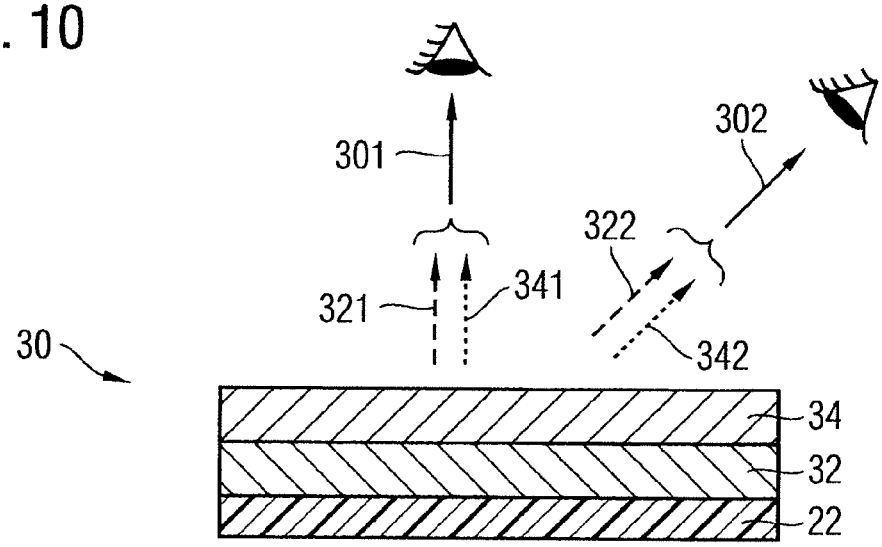
Figure 11A:
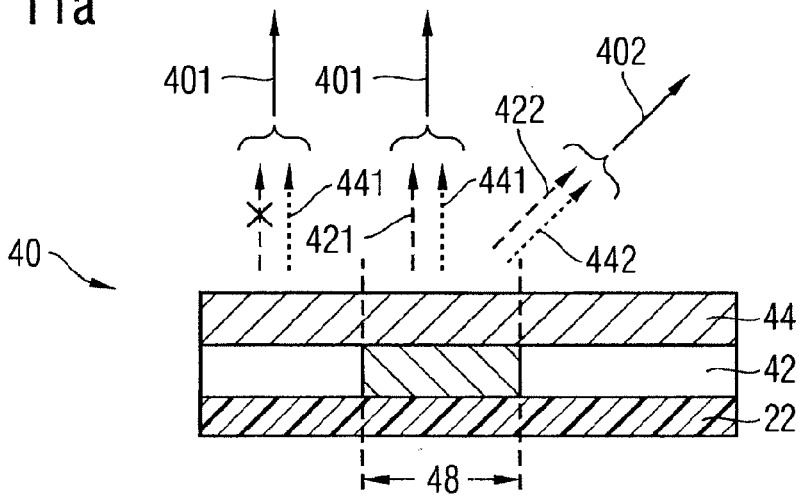
Figure 11B:
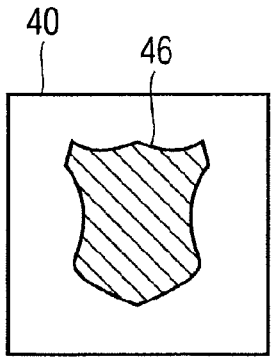
Figure 11C:
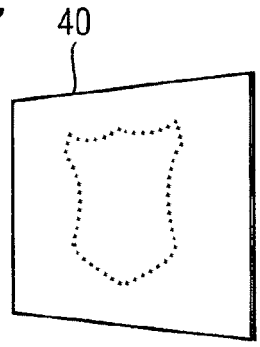
Figure 12A:
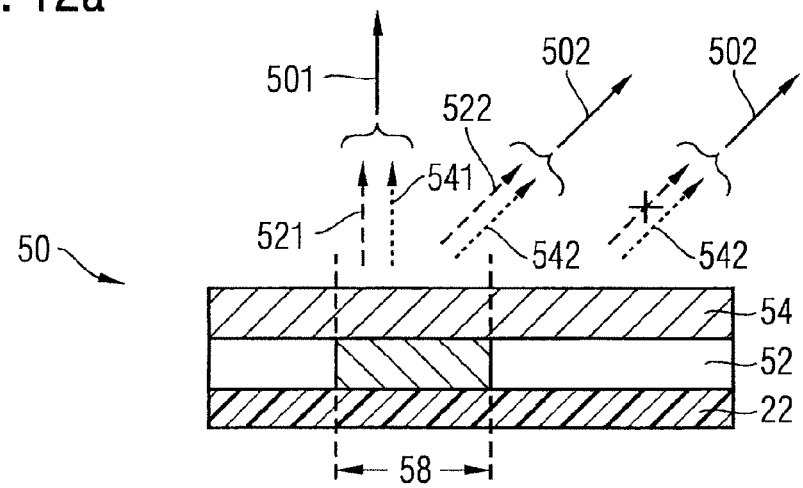
Figure 12B:
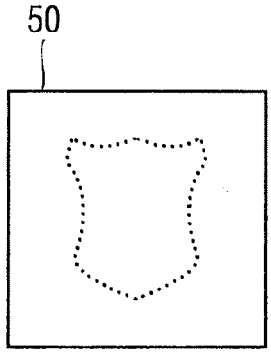
Figure 12C:
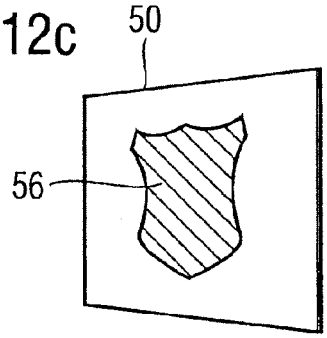
Figure 13:
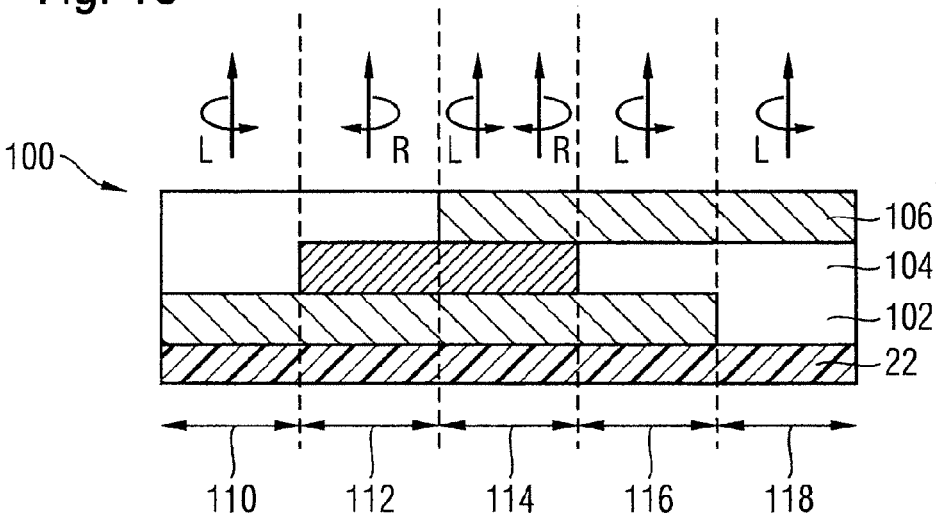
Figure 14:
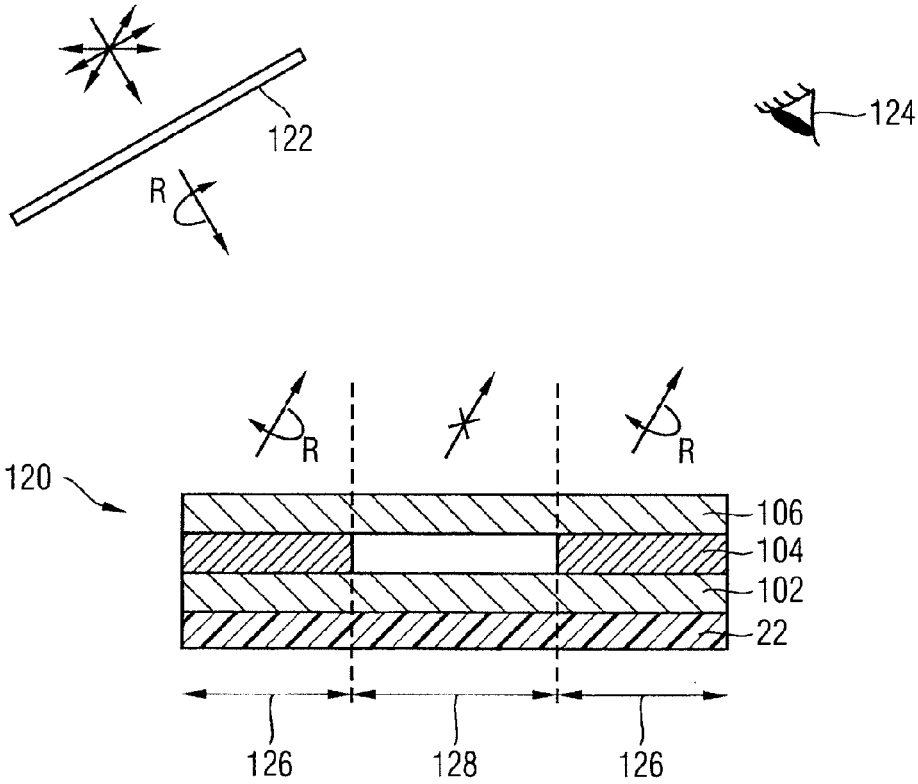
Figure 15:
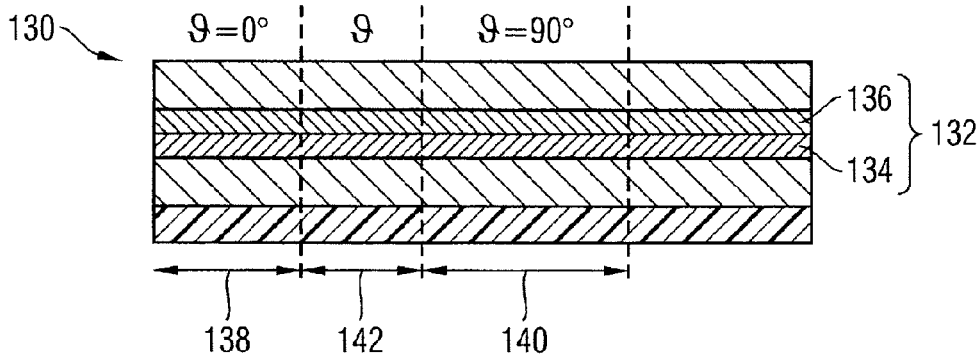
Figure 16A:
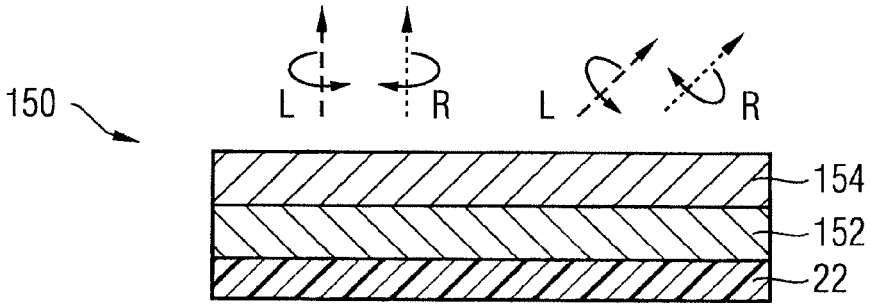
Figure 16B:
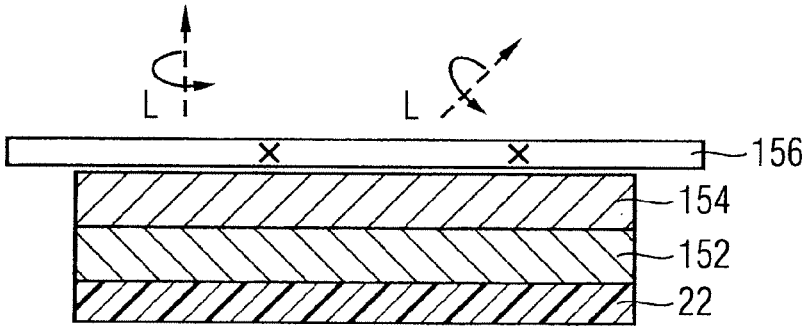
Figure 16C:
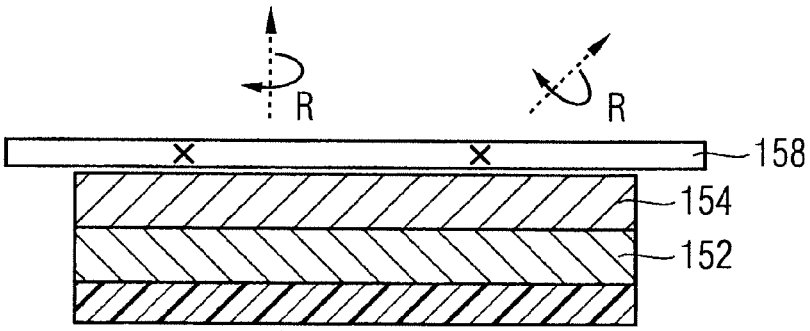

Shown are:

FIG. 1 a schematic diagram of a banknote having an embedded security thread and an affixed transfer element, each according to an exemplary embodiment of the present invention, FIG. 2 the general layer structure of a security element according to the present invention, in cross section, FIG. 3 a security element according to an exemplary embodiment of the present invention, in cross section, FIG. 4 in (a), the cross section of a security element according to another exemplary embodiment of the present invention, having a circular polarizer for reading the encoded piece of information, and in each of (b) and (c), an aspect of this security element when viewed vertically with a circular polarizer that transmits only right- or left-circularly polarized light, FIG. 5 in (a), the cross section of a security element according to another exemplary embodiment of the present invention, having a linear polarizer for reading the encoded piece of information, in (b), a schematic diagram of this security element when viewed vertically, and in each of (c) to (f), aspects of this security element when viewed vertically with a linear polarizer rotated 90° each time, FIG. 6 in (a), a schematic diagram of the relative arrangement of the inverse lettering and the code of a security element according to a further exemplary embodiment of the present invention, as viewed from above, in (b), the cross section of this security element, and in each of (c) and (d), an aspect of this security element when viewed vertically with a circular polarizer that transmits only right- or left-circularly polarized light, FIG. 7 a security element according to yet a further exemplary embodiment of the present invention, in cross section, FIG. 8 a security element according to yet a further exemplary embodiment, as viewed from above, in which both the color effects and the polarization effects of the liquid crystal layers are exploited, the security element being shown (a) on a light background or as looked through, (b) on a black background, (c) on a black background when viewed with a circular polarizer, and (d) on a light background when viewed with a circular polarizer, FIG. 9 a security element according to yet a further exemplary embodiment of the present invention, having a circular polarizer for reading the encoded piece of information, FIG. 10 a security element according to yet a further exemplary embodiment of the present invention, in cross section, FIG. 11 in (a), the cross section of a security element according to another exemplary embodiment of the present invention, in (b), an aspect of this security element when viewed vertically, and in (c), an aspect when viewed from an acute angle, FIG. 12 a diagram as in FIG. 11 of a security element according to a further exemplary embodiment of the present invention, FIG. 13 the principle of security elements having a three-layer liquid crystal structure in which a $\lambda/2$ layer is disposed between two cholesteric liquid crystal layers, FIG. 14 a security element according to the principle in FIG. 13 when illuminated with right-circularly polarized light, FIG. 15 a further security element according to the principle in FIG. 13, having a $\lambda/2$ layer broken down into two $\lambda/4$ layers, FIG. 16 a security element according to a further exemplary embodiment of the present invention, in which both the color effects and the polarization effects of the liquid crystal layers are exploited, (a) showing the layer structure of the security element, and (b) and (c) the situation when viewed through different circular polarizers.

The invention will now be explained in greater detail using a banknote as an example. FIG. 1 shows a schematic diagram of a banknote 1 that exhibits two security elements 2 and 6, each of which is formed according to an exemplary embodiment of the present invention. The first security element constitutes a security thread 2 that emerges at certain window areas 4 on the surface of the banknote 1, while it is embedded in the interior of the banknote 1 in the areas lying therebetween. The second security element is formed by an affixed transfer element 6 of any shape that was prepared on a separate layer, for example a plastic foil, in the reverse sequence to how it comes to rest on the banknote 1.

The following examples will be described based on a security element that is present in the form of a thread. However, within the scope of the present invention, it is likewise possible to give the security element any other contour shape, as well as to design it as a transfer element.

FIG. 2 shows the principle layer structure of a security element 10 according to the present invention, in cross section. Two layers 13, 14 composed of liquid crystal material are applied on a background layer 22 provided with a machine-readable feature. As described in detail below, the liquid crystal layers 13, 14 can each exhibit different, but in some cases also the same, light-polarizing or refractive properties.

According to the present invention, at least the first liquid crystal layer 13 consists of a cholesteric liquid crystal material and selectively reflects light in a first wavelength range having a first circular polarization direction. The second liquid crystal layer 14 that is stacked with the first layer in an overlap area selectively reflects, either itself or in coaction with the first layer, light in a second wavelength range having a second circular polarization direction. The second liquid crystal layer can likewise be formed from cholesteric liquid crystal material or also from nematic liquid crystal material and is present here only in some areas in the form of a motif, for example lettering, or of a pattern.

The layer 22 provided with a machine-readable feature can be formed as an opaque layer that includes or is formed from electrically conductive, magnetic, luminescent substances or substances having other machine-verifiable properties. To increase the perceptibility of the below-described color and polarization effects of the liquid crystal layers 13, 14, the opaque layer can further be present as a dark, preferably black layer.

In addition to the above-described layers, further layers can be present that, however, were omitted here for the sake of clarity. For example, the above layer structure can be present on a foil, for example a PET foil of good surface quality. In addition, between the liquid crystal layers, alignment layers and/or adhesive layers can be provided that serve to align the liquid crystals in the liquid crystal layers or to join the individual liquid crystal layers and compensate for surface irregularities in the background. Further layers, such as protective layers or separation or other auxiliary layers, can likewise be provided.

FIG. 3 shows a security element 20 according to an exemplary embodiment of the present invention, in which are disposed on an opaque, preferably black, layer 25, a first cholesteric liquid crystal layer 23 and, on this, a second liquid crystal layer 24. Here, the second liquid crystal layer 24 is present only in some areas in the form of a motif, for example lettering, or of a pattern. In the exemplary embodiment, the opaque layer 25 is disposed on a contiguously present machine-readable layer 26. This can be provided, for example, by a magnetic layer or an electrically conductive layer, especially a metal layer.

To manufacture the security element 20, the first and the second liquid crystal layer 23 and 24 can each be imprinted on a smooth PET foil of good surface quality. Here, all printing methods that are suitable for liquid crystal layers, such as intaglio printing, flexo printing, knife coating, curtain or blade techniques may be used as the printing method.

The quality and the color spectrum of the individual layers can be checked and, if applicable, spoilage eliminated already at this production stage following the drying of the liquid crystal layers 23, 24. The liquid crystal layers 23 and 24 are then laminated onto the opaque layer 25 or the first liquid crystal layer 23 with the aid of commercially available laminating adhesives. Here, the smoothness of the surface influences the gloss level of the security element. Surface irregularities in the background, such as can occur in the structure of a typical security thread 2, can be compensated for by the laminating adhesive such that a good gloss can also be achieved for such security elements.

Following the gluing of the liquid crystal layers 23 and 24, the substrate foils can be removed. This can occur, for example, via so-called separation or release layers. These are especially UV lacquers or waxes that can be mechanically or thermally activated. When separation layers are used, they can be patterned on the surface to locally promote or prevent alignment of the liquid crystals upon application. Through different alignment of the liquid crystals in some areas, motifs, such as characters, or patterns can be introduced into the liquid crystal layers, also in contiguous application.

Expediently, if no separation layer is provided, then to prevent a foil tear, a laminating adhesive is chosen whose adhesion to the substrate foil is less than its adhesion to the liquid crystal layer. Also, to facilitate separation, the adhesion of the liquid crystals to the substrate foil must be less than the adhesion of the adhesive to the liquid crystals. Further, the adhesion of the adhesive to the layer to which the system is to be transferred must be better than the adhesion of the liquid crystals to the substrate foil. Furthermore, it must also be better than the adhesion of the adhesive to the substrate foil. The preceding requirements for the laminating adhesive are especially important when the liquid crystal layer to be transferred is not formed contiguously.

After the first liquid crystal layer 23 is laminated to the opaque layer 25, the second liquid crystal layer 24 is analogously laminated onto the first liquid crystal layer 23 now lying on top in the composite.

In FIG. 3, as well as in the exemplary embodiments described below, the liquid crystal layers can each be laminated one on top of another, printed one on top of another or otherwise applied one on top of another, with, if applicable, alignment layers or adhesive layers that are not depicted being able to be provided between the layers.

FIGS. 4, 5, 6, 8, 9 and 13 to 16 show further exemplary embodiments of the present invention, in which, in addition to the color-shift effect, above all the particular light-polarizing properties of the liquid crystal layers are exploited. In these figures, the polarization direction of the light is indicated in part by additional arrow symbols at the propagation vectors of the light. As usual, a circular polarization in which the circular movement of the electric field intensity vector is clockwise from the perspective of a viewer toward whom the light wave flows is referred to as right-circular polarization, and the opposite polarization as left-circular polarization.

The exemplary embodiment in FIG. 4 shows a security element 80 having a first cholesteric liquid crystal layer 82 and a $\lambda/2$ layer 84 that is applied in some areas on the liquid crystal layer 82 and includes nematic liquid crystal material (FIG. 4(*a*)). Due to the different refractive indices of the rod-shaped liquid crystals along the principal crystal axes, is it possible to use nematic liquid crystals to manufacture optically active layers. Given an appropriately chosen layer thickness, a $\lambda/2$ layer is obtained for the wavelength range in which the first liquid crystal layer 82 selectively reflects. In the areas 86 not covered by the $\lambda/2$ layer 84, the first liquid crystal layer 82 reflects light having a preselected direction of circular polarization, for example left-circularly polarized light (L). In the overlap area 88 of the two layers, the security element 80 reflects light having the opposite polarization direction, so right-circularly polarized light (R) in the exemplary embodiment, since the incident unpolarized light is not influenced by the $\lambda/2$ layer 84, but the polarization direction of the left-circularly polarized light reflected by the first liquid crystal layer 82 is exactly reversed in its polarization orientation by the $\lambda/2$ layer 84 due to the phase difference between the ordinary and the extraordinary ray.

Without auxiliary means, the motif formed by the $\lambda/2$ layer 84 is hardly perceptible, since the security element reflects substantially the same amount of light in the covered areas as in the uncovered areas, and the unarmed eye cannot differentiate the light's circular polarization direction.

If, in contrast, the security element 80 is viewed through a circular polarizer 89 that transmits only right-circularly polarized light, then the motif formed in the $\lambda/2$ layer 84 stands out in clear contrast. Here, as shown in FIG. 4(*b*), the image portions 88 covered by the $\lambda/2$ layer 84 appear light or colored, and the uncovered image portions 86, dark or black. Here, any differences in thickness in the $\lambda/2$ layer are perceived by the viewer to a limited extent only. A reversed (negative) image impression results when a circular polarizer is used that transmits only left-circularly polarized light (FIG. 4(*c*)). The circular polarizer 89 can be formed, for example, by a linear polarizer having a downstream $\lambda/4$ plate. It is understood that also both liquid crystal layers 82, 84 can be present in the form of motifs.

The above effects can be observed when the nematic liquid crystal material is achromatically dispersive, that is, when the dispersion or the wavelength dependence of the refractive index is negligible across the chosen wavelength range. In this case, the rotation direction of the circular polarization is reversed in the nematic liquid crystal layer, the phase shift corresponding to $\lambda/2$. If the nematic liquid crystal material is chromatically dispersive, then the phase shift in the nematic liquid crystal layer is no longer exactly $\lambda/2$ for each wavelength, and elliptical polarization occurs. The nematic layer then appears more dark gray than black.

To manufacture the security element 80, a nematic liquid crystal layer 84 can first be imprinted in the form of a motif on a smooth PET foil of good surface quality in a layer thickness that is chosen such that a $\lambda/2$ layer is obtained for the wavelength range in which the first liquid crystal layer 82 selectively reflects. For example, the liquid crystal layer is applied in a coating weight of approximately 2 g/m$^2$. After physical drying to remove the solvent, the liquid crystal layer is crosslinked by means of ultraviolet radiation. A layer 82 composed of cholesteric liquid crystal material is subsequently imprinted contiguously on the PET foil coated in some areas with nematic liquid crystal material, for example likewise in a coating weight of approximately 2 g/m$^2$. It is understood that the coating quantities required here depend especially on the lacquers used. After physical drying, this layer, too, is crosslinked by means of ultraviolet radiation.

With the aid of commercially available laminating adhesives, the two-layer liquid crystal structure produced in this way is then laminated, over the cholesteric liquid crystal layer 82 now lying on top, onto an opaque, preferably black, layer 22, which in this exemplary embodiment is additionally electrically conductive. Such an electrically conductive black background can be provided by, for example, a lacquer layer colored with carbon black pigments. Alternatively, the opaque layer 22 can also be formed by a black printing ink provided with magnetic pigments. Finally, following gluing, the substrate foil can be removed. This can occur, for example, via separation layers. These are especially UV lacquers or waxes that can be mechanically or thermally activated. If no separation layer is provided, then the contiguously imprinted cholesteric liquid crystal layer 82 can serve as an auxiliary layer between the laminating adhesive and the PET foil and so prevent the foil tear that is otherwise possible when removing the PET foil and that can occur especially when transferring non-contiguous layers.

A further exemplary embodiment of the present invention is depicted schematically in FIG. 5. In the security element 90, a first liquid crystal layer 92 composed of cholesteric liquid crystal material and, on this, a second liquid crystal layer 94 composed of nematic liquid crystal material are applied in the form of a motif on an opaque, preferably black, layer 22. The layer thickness of the second nematic liquid crystal layer 94 is chosen such that it forms approximately a $\lambda/2$ layer. In this exemplary embodiment, the opaque layer 22 includes a substance composed of a magnetic material, for example in the form of magnetic pigments or magnetic iron. A section along A-A through this security element is depicted in FIG. 5(*b*).

The motif shown in FIG. 5(*a*), formed by the $\lambda/2$ layer 94 and composed of image portions 98 covered by the $\lambda/2$ layer as well as uncovered image portions 96, is hardly perceptible without auxiliary means, since the security element 90 reflects substantially the same amount of light in the covered areas as in the uncovered areas, and the unarmed eye cannot differentiate the light's circular polarization direction.

If the security element 90 is now viewed through a linear polarizer 91, further effects can be observed whose effect is caused by the main optical axis 95 of the nematic liquid crystal material. The precise layer thickness of the nematic liquid crystal layer 94 plays a rather subordinate role in this additional effect. If the linear polarizer 91 is rotated into a position in which the main optical axis 93 of the linear polarizer 91 is collinear with the main optical axis 95 of the nematic liquid crystal material (FIGS. 5(*c*), (*e*)), then the image portion 98 covered by the nematic liquid crystal layer, or the motif formed thereby, is hardly perceptible. In contrast, if the main axes 93 and 95 are turned 90° (FIGS. 5(*d*), (*f*)), then the image portion 98 covered by the nematic liquid crystal layer 94 appears black.

The circularly polarized light reflected by the cholesteric liquid crystal layer 92 constitutes a linear combination composed of linearly polarized light. Thus, in the situations depicted in FIGS. 5(*c*), (*e*), the one portion of the circularly polarized light can be perceived with the aid of the linear polarizer 91, and the other in the situations depicted in FIGS. 5(*d*), (*f*). The background formed by the uncovered image portions 96 thus appears gray to the viewer, substantially independent of the position of the linear polarizer.

FIG. 6 shows principally the external appearance of a security element 160, depicted in the form of a thread, according to a further exemplary embodiment of the present invention. To improve clarity, in FIG. 6 (*a*), only the (covered) code 165 and the gaps 163, 164 are shown in their relative position to each other on the security element 160.

The code 165 extends over the entire width of the thread. It is composed of areas 161 provided with magnetic material and magnetic-layer-free areas 162. In a special embodiment, the code 165 consists of equal-sized bit cells that either are filled with magnetic material (e.g. binary "1") or not (e.g. binary "0"). According to the present invention, the magnetic-layer-free areas 162 of the code 165 are used here to arrange the gaps that are perceptible in transmission 163, 164. In this way, the inverse lettering formed by the gaps 163, 164 and the code 165 can be provided together on a thread without impairing each other. Thus, as with threads that exhibit only inverse lettering, the gaps 163 can be disposed in the center of the thread and produced in the usual size. In addition, the thread exhibits, apart from the color-shift or polarization effects produced by liquid crystal layers 172, 174 and explained in detail below, the same external appearance as a common inverse-lettering security thread. From the outside, nothing indicates that a magnet code is simultaneously disposed on the thread.

Increased counterfeit protection is achieved if the gaps 164 are embodied as microtext characters, i.e. exhibit a significantly smaller size than the gaps 163, since the microtext characters cannot be imitated, or only with great effort. For example, the gaps 163 can exhibit a size of more than 1 mm and the gaps 164 a size of less than 1 mm.

If the security element 160 is viewed through a circular polarizer, not shown here, that transmits only right-circularly polarized light, then the motif formed in the nematic liquid crystal layer 174 designed as a $\lambda/2$ layer stands out in clear contrast. Here, as shown in FIG. 6(*c*), the image portions 168 covered by the $\lambda/2$ layer 174 appear light or colored, the uncovered image portions 166, however, dark or black. A reversed (negative) image impression results (FIG. 6(*d*)) when a circular polarizer is used that transmits only left-circularly polarized light. The motif formed by the $\lambda/2$ layer 174 is hardly perceptible without auxiliary means.

A section along B-B through this thread is depicted schematically in FIG. 6(*b*). The magnetic code 165 that is formed by the areas 161 provided with magnetic material and the magnetic-layer-free areas 162, and that is completely covered by an opaque, preferably black, layer 175, is present in the exemplary embodiment on a screened metal layer 176, which, in turn, is disposed on an at least translucent plastic layer 170, for example a PET foil. In the exemplary embodiment, the screened metal layer 176 that is denoted in the gaps 163, 164 in FIGS. 6(*a*), (*c*), (*d*) exhibits a line grating 167. This produces in the metal layer 176 a certain semi-transparency through which the gaps 163, 164 are also perceptible in transmitted light. An analogous effect can be achieved by using a very thin, continuous metal layer.

To manufacture the security element depicted in FIG. 6, in a first step, the plastic material 170 is provided with a metal layer 176 that is produced by screened application of an opaque metal layer in the form of a line grating. Alternatively, a very thin, continuous metal layer can also be vapor deposited. In the areas 161 is applied to the metal layer 176 the magnetic code 165, which is subsequently covered with an opaque, preferably black, printing ink, the inverse characters formed by the gaps 163, 164 being produced at the same time. Finally, in a last step, the liquid crystal layers 172, 174 are provided over this layer structure. Due to the semi-transparency of the metal layer, the gaps 163, 164 continue to be perceptible in transmitted light.

It is understood that the security element according to other embodiments can exhibit yet further magnetic layers. In particular, the security element according to the present invention can also be combined particularly advantageously with magnetic codes such as are known from WO 98/25236 A1.

The exemplary embodiment in FIG. 7 shows a security element 180 having a first cholesteric liquid crystal layer 182 and a second liquid crystal layer 184 that, as explained in detail below, is likewise formed from cholesteric material or from nematic liquid crystal material. The security element 180 further comprises, applied on an at least translucent plastic layer 181, a metal layer 185 that is printed on with an opaque, preferably black, layer 186. In the exemplary embodiment, the opaque layer 186 is formed by a protective lacquer that includes black pigments. The black pigments can further be provided by carbon black pigments. Such a protective lacquer then additionally exhibits a certain electrical conductivity and, accordingly, is machine-readable. To obtain a magnetizable opaque layer 186, the protective lacquer can, furthermore, be provided with magnetic pigments. On the metal layer 185 is further provided a layer 188 composed of a transparent protective lacquer.

To manufacture the gaps 183 that are present in the form of patterns and/or characters, especially in the form of inverse lettering, the metal layer 185 printed on with the black-colored and the transparent protective lacquer layer 186 and 188 with the aid of one of the known methods is partially demetallized, for example using an etchant. Here, the areas that are not provided with the protective lacquer layers 186, 188 are removed. Now, the liquid crystal layers are applied to this layer structure as described above, alignment layers or adhesive layers that are not depicted being able, if appropriate, to be provided between the layers.

If the security element 180 is viewed from the side of the liquid crystal layers 182, 184, the metal layer 185 is perceptible only in the areas provided with the transparent protective lacquer layer 188. However, in the areas in which the black-colored protective lacquer layer 186 is present, the security element exhibits the color-shift effects described here, which appear clearly due to the dark background. When viewed from the side of the translucent plastic layer 181, the opaque metal layer 185 is visible both in the areas having the transparent protective lacquer layer 188 and in the areas having the black-colored protective lacquer layer 186.

In a further exemplary embodiment of the present invention, the security element is designed in such a way that, together with the liquid crystal layers, the gaps in the opaque layer form an additional piece of information, for example a new geometric shape, both the color effects and the polarization effects of the liquid crystal layers being exploited. The principle of this exemplary embodiment will now be explained with reference to FIGS. 8(*a*) to (*d*), which depict a security element 190 according to the present invention in different situations.

The security element 190 exhibits a layer structure whose layer sequence substantially corresponds to the layer sequence depicted in FIG. 3. However, in the exemplary embodiment, the metal layer 191 is designed as a thin, semi-transparent or screened metal layer that is present contiguously. Disposed on the metal layer 191 is an opaque, preferably black, layer, not depicted in FIG. 8, on which an overlapping cholesteric liquid crystal layer 192 is present. The liquid crystal layer 192 stands out clearly in the form of a triangle 194 only in the areas in which it overlaps with the opaque layer. The image portions 196 covered by the one λ/2 layer composed of nematic liquid crystal material are merely denoted by a dotted line in FIG. 8(*a*) and are hardly perceptible without auxiliary means, since the security element reflects substantially the same amount of light in the covered areas as in the uncovered areas.

If the security element 190 is disposed on a black underlay 198 (FIG. 8(*b*)), the star-shaped pattern formed by the cholesteric liquid crystal layer 192 appears substantially completely. If, in contrast, the security element 190 is viewed through a circular polarizer 199 that transmits only light of one circular polarization, for example left-circularly polarized light, then the motif formed in the nematic liquid crystal layer designed as a λ/2 layer stands out clearly in the form of a hexagon. Here, as shown in FIG. 9(*c*), the image portions 196 covered by the λ/2 layer appear dark or black, the uncovered image portions, however, light or colored. A reversed (negative) image impression results when a circular polarizer is used that transmits only right-circularly polarized light. The situation depicted in FIG. 8(*d*) corresponds to that depicted in FIG. 8(*c*) except for the fact that the security element 190 is present here on a light underlay. The liquid crystal layer 192 thus stands out clearly only in the areas that overlap with the opaque layer.

FIGS. 9 to 16 schematically show further exemplary embodiments of the present invention, in which especially the particular properties of the liquid crystal layers are used.

The security element 60 in FIG. 9 includes two cholesteric liquid crystal layers 62 and 64 that, in the exemplary embodiment, are applied on an opaque, preferably black, layer 22 provided with a machine-readable feature. Further layers can, of course, also be provided in the layer structure. The two liquid crystal layers 62 and 64 exhibit the same color reflection spectrum, but differ in the orientation of the reflected circular polarization. While the first liquid crystal layer 62 in the exemplary embodiment reflects left-circularly polarized light, the second liquid crystal layer 64 reflects right-circularly polarized light. Left-circularly polarized light, in contrast, is transmitted by the second liquid crystal layer 64 without substantial absorption. It is understood that the indicated polarization directions are for illustration purposes only and, in the context of the present invention, can, of course, also be chosen differently.

One such opposite selective reflection can be achieved, for example, in that the two cholesteric liquid crystal layers 62 and 64 are produced from the same nematic liquid crystal system using mirror-image twisters. In this way, a mirror-image helix-like arrangement of the rod-shaped liquid crystal molecules can be achieved in the two liquid crystal layers such that one layer reflects right- and the other layer left-circularly polarized light. The color of the light reflected by the liquid crystal layers depends, as in the above-described exemplary embodiments, on the viewing direction, and changes upon the transition from vertical to acute-angled viewing, for example from red to green.

In the exemplary embodiment in FIG. 9, the first liquid crystal layer 62 is present only in some areas in the form of a motif, for example lettering, or of a pattern. If the security element 60 is viewed without auxiliary means, then primarily the color-shift effect of the second liquid crystal layer 64 appears. In the overlap area 68 of the two layers, the motif is perceptible with the same color impression, but an increased brightness compared with its surroundings since, in the overlap area 68, light of both circular polarization directions is reflected, while outside, only right-circularly polarized light is reflected, as shown by the arrows 70 of the reflected light.

If the security element 60 is now viewed through a circular polarizer 72 that transmits only left-circularly polarized light, then the motif formed by the first liquid crystal layer 62 stands out with a strong brightness contrast, since the circular polarizer 72 completely blocks out the right-circularly polarized light reflected by the second liquid crystal layer 64. As described above, such a circular polarizer 72 can be formed, for example, by a linear polarizer and a following λ/4 plate.

It is understood that, analogously, the second liquid crystal layer 64 or also both liquid crystal layers 62, 64 can be present in the form of motifs. Accordingly, a motif in the second liquid crystal layer 64 can be made clearly visible with the aid of a circular polarizer that transmits right-circularly polarized light. The motifs in one or both layers can easily be shown with a viewing device that includes both polarizer types.

FIG. 10 shows a security element 30 according to an exemplary embodiment of the present invention, in which on an opaque, preferably black, layer 22 provided with a machine-readable feature are disposed a first cholesteric liquid crystal layer 32 and, on this, a second cholesteric liquid crystal layer 34. Due to the interplay of the two liquid crystal layers 32 and 34, the security element 30 exhibits a novel color-shift effect that gives the viewer a color impression that changes with the viewing direction. When viewed vertically, the security element 30 in the exemplary embodiment appears to the viewer blue/violet (reflected radiation 301), while, when viewed from an acute angle, it gives a red color impression (reflected radiation 302).

This novel play of changing colors, in which the color impression of the security element changes from short-wave to longer-wave light when tilted, occurs in that the first liquid crystal layer 32 reflects blue light (arrow 321) in the vertical viewing direction and shorter-wave UV-radiation (arrow 322) in the acute-angled viewing direction. The second liquid crystal layer 34 is formed such that it reflects infrared radiation (arrow 341) in the vertical viewing direction and shorter-wave red light (arrow 342) in the acute-angled viewing direction. The two reflection portions 321 and 342 that lie outside of the visible spectral range contribute nothing to the color impression of the security element such that, when viewed vertically, a blue color impression 301 and, when viewed at an acute angle, a long-wave red color impression 302 results for the viewer.

A further exemplary embodiment of the present invention is depicted schematically in FIG. 11. In the security element 40, on an opaque, preferably black, layer 22 provided with a machine-readable feature are applied a first cholesteric liquid crystal layer 42 and, on this, a second cholesteric liquid crystal layer 44. As shown in FIG. 11(*b*), the first liquid crystal layer 42 is applied to the opaque layer 22 only in some areas and, by the shape or the contour of the applied areas, forms a motif, in the exemplary embodiment a crest 46. The second liquid crystal layer 44 is applied contiguously to the first liquid crystal layer 42 or to the uncovered areas on the opaque layer 22.

The two liquid crystal layers are coordinated such that, when the security element is viewed vertically (FIG. 11 (*b*)), the crest motif 46 is clearly perceptible for the viewer, and disappears when the security element 40 is tilted, that is, upon transition from a vertical to an acute-angled view, as indicated by the dotted outline in FIG. 11(*c*). The disappearance of the crest motif 46 is achieved in that, when tilted, the liquid crystal layer 42 applied in some areas displays a color-shift effect from blue (arrow 421) to ultraviolet (arrow 422), while the second liquid crystal layer 44 exhibits a color-shift effect that changes between two colors of the visible spectral range, and varies for example between red (arrow 441) and green (arrow 442).

Thus, in the overlap area 48 of the two layers, when the security element 40 is viewed vertically, a color impression 401 results that is given by the additive color mixing of the blue light 421 of the first liquid crystal layer 42 and of the red light 441 of the second liquid crystal layer 44, while outside the overlap area, only the red color impression of the second liquid crystal layer 44 is perceptible. Due to the color contrast in the reflected light 401, the crest motif 46 stands out clearly for the viewer.

If the viewer now tilts the security element 40 such that he sees it at an acute angle, then, in the overlap area 48, the first liquid crystal layer 42 reflects to the viewer only ultraviolet light lying outside of the visible spectral range. Thus, the liquid crystal layer 42 does not contribute to the color impression 402 of the security element 40, either in the overlap area 48 or outside of the overlap area. At an acute viewing angle, the motif is thus not perceptible, and the viewer has the impression that the crest motif 46 disappears when the security element 40 is tilted out of the vertical.

Analogously, a security element 50 can be produced having a motif that appears when tilted, as depicted in FIG. 12. For this, a cholesteric liquid crystal layer 52 that is applied in some areas is formed such that, when tilted, it displays a color-shift effect from infrared (arrow 521) to red (arrow 522). A second cholesteric liquid crystal layer 54 again displays a color-shift effect between two colors of the visible spectral range, and varies for example between teal (arrow 541) and violet (arrow 542).

In this combination, the motif 56 is not perceptible when viewed vertically in the reflected light 501 since, from the first liquid crystal layer 52, at most non-visible infrared radiation is reflected in the vertical viewing direction. Only when the security element 50 is tilted does the motif become perceptible for the viewer, since the first liquid crystal layer 52 then reflects red light to the viewer, and the motif 56 thus stands out in the reflected light 502 from the violet color impression outside of the overlap area 58.

In further exemplary embodiments of the present invention, the security element exhibits a three-layer liquid crystal structure in which a λ/2 layer is disposed between two cholesteric liquid crystal layers having the same light-polarizing properties. The principle of these exemplary embodiments will now be explained with reference to FIG. 13.

The security element 100 exhibits, applied on an opaque, preferably black, layer 22 provided with a machine-readable feature, a layer sequence that consists of a first cholesteric liquid crystal layer 102, a λ/2 layer 104 composed of nematic liquid crystal material, and a second cholesteric liquid crystal layer 106. The light-polarizing properties of the first and second liquid crystal layer 102 and 106 are identical, such that the two layers in themselves reflect light in the same preselected wavelength range and having the same preselected circular polarization direction. All layers can be applied contiguously or also only in some areas, to form different or complementary motifs, such as characters, or patterns.

The reflection properties of the various possible layer sequences are exemplified in FIG. 13. Here, it is assumed that the two cholesteric liquid crystal layers 102 and 106 reflect left-circularly polarized light and the illumination of the security element occurs with unpolarized light.

In a first area 110 in which only the first liquid crystal layer 102 is present, left-circularly polarized light is reflected. In a second area 112 in which the first liquid crystal layer 102 is covered by the λ/2 layer 104, the security element reflects, as already explained in connection with FIG. 4, right-circularly polarized light. In a third area 114 in which all three layers are present, the upper liquid crystal layer 106 reflects left-circularly polarized light and transmits right-circularly polarized light. The transmitted light is converted by the λ/2 layer 104 into left-circularly polarized light that is then reflected by the first liquid crystal layer 102. The reflected light is converted by the λ/2 layer 104 back into right-circularly polarized light that is transmitted by the second liquid crystal layer 106. Thus, in addition to left-circularly polarized light, the sequence of layers 102, 104, 106 also reflects right-circularly polarized light, as depicted in FIG. 13.

In the fourth area 116 in which only the two cholesteric liquid crystal layers 102 and 106 are present, the upper liquid crystal layer 106 reflects left-circularly polarized light. The transmitted right-circularly polarized light is likewise transmitted by the lower liquid crystal layer 102 and absorbed in the black layer 22. Thus, in this area, the security element reflects only left-circularly polarized light. The same is true for the fifth area 118 in which the second liquid crystal layer 106 is present alone.

The numerous variation possibilities resulting from the different layer sequences permit a number of application possibilities for security elements, of which only a few will be exemplified in greater detail.

The security element 120 in FIG. 14 comprises, like the above-described security element 100 in FIG. 13, applied on an opaque, preferably black, layer 22 provided with a machine-readable feature, a layer sequence composed of a first cholesteric liquid crystal layer 102, a λ/2 layer 104 composed of nematic liquid crystal material and a second cholesteric liquid crystal layer 106. In this exemplary embodiment, merely the λ/2 layer 104 is designed in the form of a motif, while the first and second liquid crystal layer 102 and 106 are applied contiguously.

Upon normal illumination with unpolarized light, the motif of the λ/2 layer 104 does appear with the same color impression as its surroundings, but due to the reflection of both the left-circularly and the right-circularly polarized light, it is perceptible in the areas 126 even without auxiliary means due to the substantially double amount of light reflected. Furthermore, if the security element 120 is illuminated with right-circularly polarized light via a circular polarizer 122, then, without further auxiliary means, the motif appears in strong contrast for the viewer 124, since the right-circularly polarized light is reflected in the areas 126 in which all three layers overlap, while it is transmitted in the areas 128 without the λ/2 layer 104 by the upper and lower liquid crystal layer 106 and 102, and absorbed in the black layer 22.

FIG. 15 shows a security element 130 according to a further exemplary embodiment of the present invention that, as regards its layer sequence, is structured substantially like the security element 120 in FIG. 14. In contrast to the security element described there, the intermediate layer 132 of the security element 130 is composed of two λ/4 sub-layers 134 and 136 that can be twisted toward one another locally in their orientation in the layer plane.

If, in a sub-area 138, the sub-layers 134 and 136 are untwisted, that is, stacked at a rotation angle θ=0°, then together they form a λ/2 layer that, like the λ/2 layer 104 in the exemplary embodiment in FIG. 14, ensures that, in the sub-area 138, right-circularly polarized light is reflected by the layer sequence. In another sub-area 140, the two λ/4 layers 134 and 136 are applied twisted toward each other in their orientation by a rotation angle of θ=90°, such that their effect on incident circularly polarized light is just neutralized. In the sub-area 140—analogously to the sub-area 128 in FIG. 14—right-circularly polarized light is thus transmitted by the layer sequence and, finally, absorbed by the black layer 22.

If, in a sub-area 142, the two λ/4 layers 134 and 136 are twisted toward each other in their orientation by a rotation angle θ between 0° and 90°, then the intermediate layer 132 causes a certain portion of right-circularly polarized light to be reflected by the layer sequence. The size of the reflected portion decreases continuously with increasing rotation angle. Through a different rotation angle θ in different surface areas of the intermediate layer 132, it is possible to encode in the security element, for example, halftone motifs that hardly appear when illuminated with unpolarized light, but that, without further auxiliary means, appear for the viewer as grayscale images when illuminated with circularly polarized light.

It is understood that, analogously, the λ/2 layer can, of course, likewise be substituted by two λ/4 sub-layers also in layer sequences that exhibit no second cholesteric liquid crystal layer, as shown for example in the exemplary embodiment in FIG. 4. Furthermore, these λ/4 sub-layers can be twisted toward each other locally in their orientation in the layer plane.

FIG. 16 shows an exemplary embodiment in which both the color effects and the polarization effects of the liquid crystal layers are exploited. FIG. 16(*a*) shows the structure of a security element 150 having, applied on an opaque, preferably black, layer 22 provided with a machine-readable feature, a first cholesteric liquid crystal layer 152 and a second cholesteric liquid crystal layer 154 applied thereon.

The first liquid crystal layer 152 exhibits a first color-shift effect, for example from green to blue, and in addition, reflects only light of a preselected circular polarization direction, for example right-circularly polarized light. The second liquid crystal layer 154 exhibits a second color-shift effect, for example from magenta to green, and in addition, reflects only light of the circular polarization direction opposite to the first liquid crystal layer, in the exemplary embodiment, left-circularly polarized light. If the security element 150 is viewed when illuminated with unpolarized light and without auxiliary means, then the two color-shift effects overlap due to additive color mixing of the reflected light.

If the security element 150 is viewed through a circular polarizer 156 that transmits only right-circularly polarized light, then it is possible to observe the color-shift effect of the first liquid crystal layer 152 alone when the security element is tilted, as illustrated in FIG. 16(*b*). In contrast, through a circular polarizer 158 that transmits only left-circularly polarized light, only the color-shift effect of the second liquid crystal layer 154 appears, as depicted in FIG. 16(*c*). It is understood that each of the liquid crystal layers 152, 154 can also be substituted by a combination of a λ/2 layer with a cholesteric layer that is the mirror-image of the original layer.

Of course, in the exemplary embodiments in which the color-shift effects and the particular light-polarizing properties of the liquid crystal layers are exploited, instead of an opaque, preferably black, layer 22 provided with a machine-readable feature, one of the layer sequences described with reference to FIG. 3, 6 or 7 can also be provided.

The invention claimed is:

1. A security element for securing valuable articles, comprising a first layer comprising cholesteric liquid crystal material, a second layer comprising liquid crystal material, wherein the second layer forms a phase-shifting layer, the second layer characterized in that the second layer, for light from a wavelength range reflected by the first layer, substantially forms a λ/2 layer, a further layer, having a machine-readable feature, that is covered at least in some areas by the first and second layers, and an opaque layer that is provided at least in some areas and that is present as a separate layer, and wherein the opaque layer forms a dark background for the first and/or second layer, and wherein the opaque layer is between the further layer and the first and second layers.

2. The security element according to claim 1, characterized in that, in the opaque layer, first gaps in the form of patterns and/or characters that are perceptible in transmission are provided as a first piece of information.

3. The security element according to claim 2, characterized in that a second piece of information is provided in the form of second gaps in the opaque layer that differ in size from the first gaps.

4. The security element according to claim 2, characterized in that the first and/or second gaps in the opaque layer constitute, together with the first and/or second layer composed of liquid crystal material, an additional piece of information.

5. The security element according to claim 1, characterized in that the opaque layer is formed from black printing ink or a black colored lacquer.

6. The security element according to claim 1, characterized in that the opaque layer is magnetically and/or electrically conductive and/or luminescent.

7. The security element according to claim 1, characterized in that the circular polarization direction of the light that the second layer reflects, itself or in coaction with the first layer, is opposite to the circular polarization direction of the light reflected by the first layer.

8. The security element according to claim 1, characterized in that the second layer is formed from nematic liquid crystal material.

9. The security element according to claim 1, characterized in that the security element exhibits at least one third layer comprising cholesteric liquid crystal material.

10. The security element according to claim 1, characterized in that at least one of the first and second layers is present in the form of characters and/or patterns.

11. The security element according to claim 1, characterized in that at least one of the first and second layers is present in the form of pigments that are embedded in a binder matrix.

12. The security element according to claim 1, characterized in that a separate first magnetic layer is provided at least in some areas.

13. The security element according to claim 12, characterized in that the opaque layer is located between the separate first magnetic layer and the first and second layers, is covered by the opaque layer.

14. The security element according to claim 12, characterized in that the separate first magnetic layer is present in the form of spaced apart magnetic areas that form a code.

15. The security element according to claim 14, characterized in that the code extends only across a sub-area of the security element.

16. The security element according to claim 14, characterized in that a second magnetic layer joins the magnetic areas of the code formed by the separate first magnetic layer.

17. The security element according to claim 12, characterized in that first and/or second gaps are disposed in the magnetic-layer-free in-between areas.

18. The security element according to claim 12, characterized in that the separate first magnetic layer is present in the form of longitudinal strips that run parallel to the thread direction.

19. The security element according to claim 12, characterized in that a second magnetic layer is provided.

20. The security element according to claim 1, characterized in that a separate electrically conductive layer is provided at least in some areas.

21. The security element according to claim 20, characterized in that the separate electrically conductive layer is present in the form of a layer that is formed from electrically conductive strips that run parallel to the thread direction, or that is substantially transparent.

22. The security element according to claim 1, characterized in that a separate metallic layer is provided at least in some areas.

23. The security element according to claim 22, characterized in that the separate metallic layer exhibits gaps.

24. The security element according to claim 22, characterized in that the separate metallic layer is a screened metal layer or a thin, contiguous semitransparent metal layer.

25. The security element according to claim 24, characterized in that the screened metal layer exhibits a negative screen, especially in the form of transparent dots, a positive screen, especially in the form of metallic dots, or a line grating, especially in the form of metallic diagonal strips.

26. The security element according to claim 24, characterized in that the semitransparent metallic layer exhibits an opacity of 40% to 90%.

27. The security element according to claim 22, characterized in that the opaque layer is located between the first and second layers.

28. The security element according to claim 22, characterized in that the separate metallic layer is covered at least in some areas by a black-colored lacquer.

29. The security element according to claim 28, characterized in that, in addition to the black-colored lacquer, also areas of a layer composed of a transparent lacquer are applied on the separate metallic layer.

30. The security element according to claim 22, characterized in that the separate metallic layer exhibits magnetic properties.

31. The security element according to claim 1, characterized in that at least one of the layers of the security element includes at least one additional authenticating feature.

32. The security element according to claim 31, characterized in that the additional authenticating feature is selected from the group consisting of luminescent substances, color pigments and effect pigments.

33. The security element according to claim 32, characterized in that the luminescent substance emits in the visible wavelength range after excitation with an excitation radiation that lies outside of the visible spectral range.

34. The security element according to claim 1, characterized in that a separate layer having a luminescent substance is provided that is present in some areas.

35. The security element according to claim 1, characterized in that the layers of the security element are disposed on a translucent plastic layer or plastic foil.

36. The security element according to claim 1, characterized in that the security element exhibits the form of a strip.

37. The security element according to claim 1, characterized in that the second layer is formed from nematic liquid crystal material.

* * * * *